US005857709A

United States Patent [19]

Chock

[11] Patent Number: 5,857,709

[45] Date of Patent: Jan. 12, 1999

[54] ANTICOUNTERFEIT DOCUMENTATION WITH SEE-THROUGH AND WRITE-ABLE HOLOGRAM

[76] Inventor: Ernest P. Chock, 1048 24th St., Santa Monica, Calif. 90403-4528

[21] Appl. No.: 805,130

[22] Filed: Feb. 24, 1997

[51] Int. Cl.[6] ..... B42D 15/00

[52] U.S. Cl. ..... 283/86; 285/58; 359/2

[58] Field of Search ..... 283/85, 86, 58, 283/92, 94, 103, 114, 901; 359/1, 2; 430/1, 2

[56] References Cited

U.S. PATENT DOCUMENTS

| | | | |
|---|---|---|---|
| 4,634,148 | 1/1987 | Greene | 283/58 |
| 5,109,318 | 4/1992 | Mantegazza | 283/58 |
| 5,267,753 | 12/1993 | Chock | 283/86 |
| 5,509,692 | 4/1996 | Oz | 283/58 |
| 5,636,874 | 6/1997 | Singer | 283/58 |

*Primary Examiner*—Willmon Fridie, Jr.
*Attorney, Agent, or Firm*—T. J. Singh

[57] ABSTRACT

A security document form such as a bank draft, or other document of value may incorporate a see-through and write-able hologram or diffractive grating as an anticounterfeit measure. The hologram may extend over all or a portion of the form such as the signature entry area and other data entry areas of the form, e.g. the date, name and numerical value areas. A Previous patent utilizing metallized holograms for such applications does not permit good photocopying or microfilming of the document on account of their high reflectance. This photocopying problem is solved by using a see-through, writable hologram which allows clearly legible photocopies to be made for legitimate use but appearing clearly fraudulent when passed off as the original. An ink-compatible top surface is made by coating with ink-receptive material or by corona discharge treatment as is well known in the industry. Writing or impact printing over the ink-compatible surface of the hologram partially occults the hologram underneath such writing and may cause the embossed surface of the hologram to become etched, so that even if the ink is somehow erased or removed, the writing trace would still remain, thus making it unalterable. The use of such an overlaminated hologram or diffractive grating can be accomplished by tamper-proof pressure sensitive holographic labeling, by hot-stamping the hologram with heat activated adhesive backing, or by embossing the hologram onto polymeric thermoplastic directly coated on the substrate paper or plastic card. The use of such a writable hologram also permits incorporation, of many other anticounterfeit features. Optionally, the hologram may also be covered with a protective laminate after the writing has been applied. This invention thus offer an aesthetically pleasing and cost effective means of forgery prevention for large volume users, while making it prohibitively costly for those attempting to counterfeit.

13 Claims, 5 Drawing Sheets

Biasing motor sense combs with fixed voltage and blocking capacitor.

Biasing motor sense combs with fixed voltage and blocking capacitor.

Biasing motor sense combs with voltage applied to preamplifier positive input.

ANTICOUNTERFEIT DOCUMENTATION WITH SEE-THROUGH AND WRITE-ABLE HOLOGRAM

FIELD OF THE INVENTION

This invention relates to security documents and devices having holographic surfaces, including diffractive grating surfaces. More particularly, the invention relates to methods for individualizing such surfaces for security and authentication purposes through the use of writable see-through holograms. In the context of this invention, "holograms" are defined as embossed holograms, including embossed diffractive gratings.

BACKGROUND

The ease with which modern computer graphic systems and high resolution copiers can generate high quality fake documents has caused a rapid and dramatic increase in document fraud. Commonly forged documents include checks, and other documents such as birth certificates, travelers checks, stock certificates, credit cards, receipts for valuables; government documents such as immigration papers, identification cards, social security cards, permits, licenses, tax documents, and other valuable documents such as property title papers, academic transcripts, diplomas, admission tickets, lottery tickets, etc. Holograms have been incorporated into security documents such as credit cards and driver licenses for many years to increase the difficulty of forging them. Holograms can be made very difficult to duplicate even for expert holographers. For examples, computer generated 2D or 3D holograms, in true color, in multiplexes, in many levels (up to 17), or holograms with covert images that are visible only under specific light or condition, etc.

Dennison discloses a method for mass-producing holograms for use with security documents (WO8903760) by coating thermoplastic onto metallized paper and/or heat-resistant plastic substrates which may be employed for embossing holograms or diffractive patterns at high speed. If non-holographic information or art work is to be printed over the top surface, the hologram can be covered with an ink-compatible layer to make it ink-receptive. However, such holograms are conventionally protected with a transparent laminate to preserve the integrity of the holograms and to deter their duplication.

A variety of patents have been issued for using non-continuous reflective holograms to deter forgery. For example, Malik U.S. Pat. No. 5,411,296 for laminating written personal data, photos, and the like between a substrate and a protected discontinuous hologram; Malik U.S. Pat. No. 5,145,212, for using analogous protected discontinuous holograms including a non-transparent structure of 2 side-by-side non-continuous holograms, each restructuring a separate image; Malik U.S. Pat. No. 5,142,383, for discontinuous metallized holograms including alpha-numeric shapes; and Malik U.S. Pat. No. 4,921,319 for surface relief holographic structure with reflection from an air interface created by adhesive or spacer and welded edges. Boswell (U.S. Pat. No. 5,464,690) for another example, describes a method of hot stamping finalized document with metallized hologram.

A magnetic layer or magnetic ink has also been used on holograms to increase the difficulty of forging. For examples, Sander (U.S. Pat. No. 4,631,222) describes a hot embossed holographic layer on top of a magnetic layer; Suess et al U.S. Pat. No. 5,383,687 disclose a method for producing an embossed holographic layer with an additional magnetic layer and a metallic layer.

With the exception of U.S. Pat. No. 5,267,753 which involves writable metallized holograms on checks, where the hologram is deliberately intended to be partially destroyed by the writing or printing, all the anticounterfeit holograms are covered with a protective top layer. In metallized holograms, however, the high reflectance from the reflective metal causes black blotches in photocopies when reproduced with a microfilm camera or photo-copier. This is an undesirable feature for the banking industry which microfilms or otherwise photocopies their checks daily. What is needed is a see-through writable hologram with lower reflectance that would permit microfilming and photocopying to yield a clearly legible copy for legitimate record purposes but clearly illegitimate when passed off as an original.

See-through holograms on paper or plastic substrate can be made by coating polymer/thermoplastic such as polypropylene, polyvinyl chloride, polyester, or styrene, etc. and embossing the hologram on it, as is well known in the industry. Slightly more reflective holograms can also be made by depositing very slight amount of metal, of the order of nanometer thickness. These polymeric layer can also accept additives to enhance counterfeit resistance while remaining essentially transparent and not too highly reflective as in the case of metallized holograms. There are several materials that are suitable as additives to the polymer used for fabricating a see-through and writeable holograms. Addition of such materials to the see-through writeable hologram can enhance their easy authentication and increase their counterfeit-resistance. Among these materials are:

(a) Thermochromic dyes that changes color upon temperature change (when pressed between two fingers, for example) can be added to the holographic polymeric resin or to the printing ink on the paper to be covered with the hologram. Borowski (U.S. Pat. No. 5,403,039), for example, describes a thermochromic printing ink for lottery tickets. In some cases, the stability of the dye can be improved by incorporating the dye in the plastic solid, or in others, by laminating it between protective layers.

(b) Photochromic dyes that can reversibly change color upon exposure to light can be incorporated into the ink or into polymer comprising the hologram. Tagaya, et a, U.S. Pat. No. 5,474,715 for example, describe methods of incorporating photochromic material in thin film.

(c) Fluorescent dyes with high extinction coefficients that can emit at specific wavelengths when excited with a light source at another specific wavelength. Such dyes can also be incorporated into polymeric resins used for making the hologram or printed on the document before covering it with the transparent hologram. Sachetti (U.S. Pat. No. 5,172,937), for example describes the use of fluorescent and phosphorescent dyes for attractive and protective labels. Fluorescent and phosphorescent compounds have been available from many companies such as SICPA Secureink Corporation, De la Rue Corp., etc.

SUMMARY

The invention is a see-through hologram coated over the entire security document or a fraction thereof. Security documents in this context include, but are not limited to, bank drafts, traveler's checks, birth certificates, stock certificates, property title papers, immigration papers, tax documents, academic transcripts and diplomas, membership or award certificates, receipts for valuables, permits, licenses, driver's license, identification cards, social security cards, entitlement cards, credit cards, lottery tickets, admission tickets and the like. "Document" in this context refers to a paper substrate, as in checks or certificates, or plastic substrate, as in plastic credit cards or identification cards.

In its first, most elementary embodiment, the holographic document is printed similarly to a conventional document except that all or portion of the top surface of the document, including the signature entry area, and/or other areas for entry of important information, such as the name, the monetary value, date, etc. is (are) covered with a writeable see-through hologram. The top surface of the hologram is a transparent ink-compatible material for writing or marking ink images thereon. Upon application of the signature, writing or printing over the hologram, the pen, impact printer, or laser writer, etc. would partially destroy the embossing of the hologram. This occultation and/or etching of the hologram largely neutralizes the utility of its direct image copy reproduction by counterfeiters. Even if the ink of the writing was somehow erased or removed, traces of the writing would remain. Such see-through hologram thereby discourages counterfeiters from altering the writing, printing or signature. Thus, documents onto which such writable see-through holograms are incorporated are given an increased security in terms of counterfeit resistance.

In a variation of the first embodiment, on a conventionally printed document, a small hologram may be employed to cover only the signature area, or several such holograms may be employed to cover several areas of the document. In either case, the hologram(s) of this embodiment cover both the signature entry area and/or various other data entry areas, e.g., areas for entering the date, name of the payee or owner, amount of the monetary value, etc. In this embodiment, the signature entry area and the various data entry areas are coated with a see-through hologram with an ink-receptive top layer for the destructive writing, printing or etching.

In a third embodiment, a variation of the first and/or second embodiment, fluorescent ink may be used to print a portion of the substrate to be covered with the hologram.

In a fourth embodiment, which is a variation of the third embodiment, the document may be covered with hologram (s) whose polymer is doped with small concentration of fluorescent dye having high extinction coefficient or high quantum yield.

In a fifth embodiment, a variation of the third embodiment, instead of fluorescent dye(s), thermochromic material may be used in printing portion(s) of the substrate paper or plastic card.

In a sixth embodiment, a variation of the fourth embodiment, instead of fluorescent dye(s), small concentration of thermochromic dye is added into the polymeric make up of the hologram. In a seventh variation of the third embodiment instead of fluorescent ink photochromic ink is used to print part of the substrate paper or plastic card.

In an eighth embodiment, a variation of the fourth embodiment, instead of fluorescent dye, small concentration of photochromic dye is included in the polymer of the hologram.

In a ninth embodiment, a variation of the third claim, magnetic ink is used in printing portion(s) of the substrate paper or plastic card.

In a tenth embodiment, a variation of the first or second embodiment, one dimensional or two dimensional bar code may be printed on the substrate paper or plastic card, or on the top of the hologram surface.

In an eleventh embodiment, a variation of any of the above embodiment, a transparent top protective cover is added after the writing has been entered.

DETAILED DESCRIPTION

Figure 1:
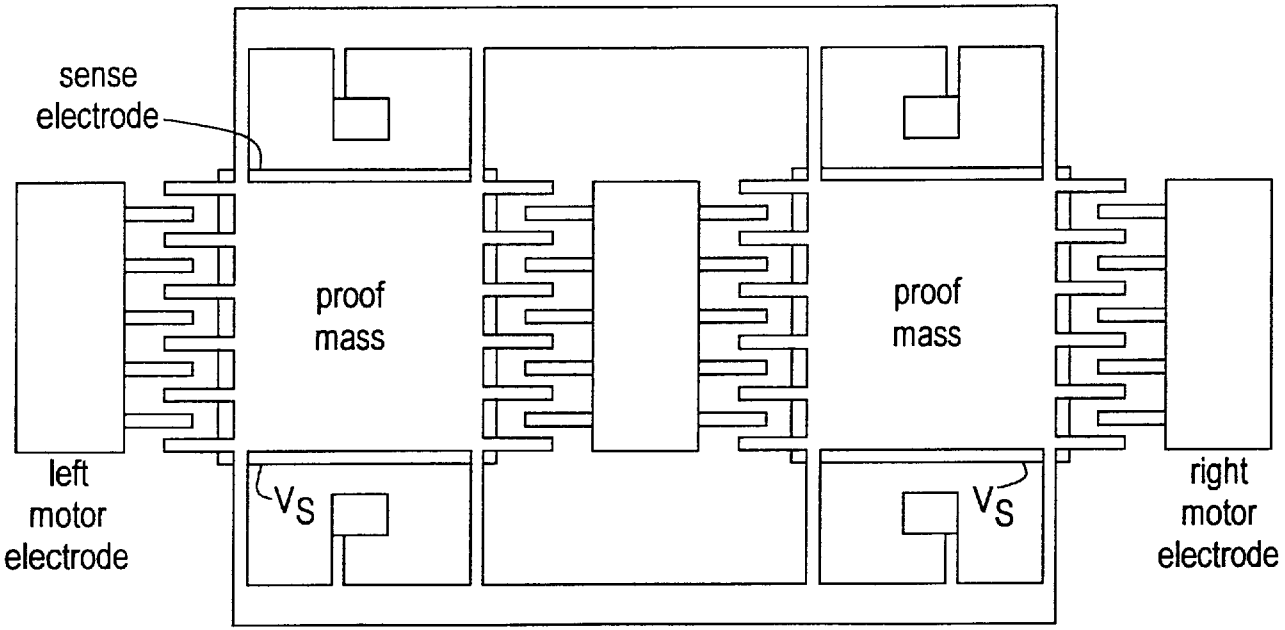
FIG. 1 PRIOR ART
FIG. 1 is a plan view of an unsigned or unissued document, in this case, represented by a bank draft having a single large hologram encompassing both the signature entry area and the date entry areas, the signature entry area and the date entry areas having a see-through hologram with an ink-compatible top surface.
Figure 2:
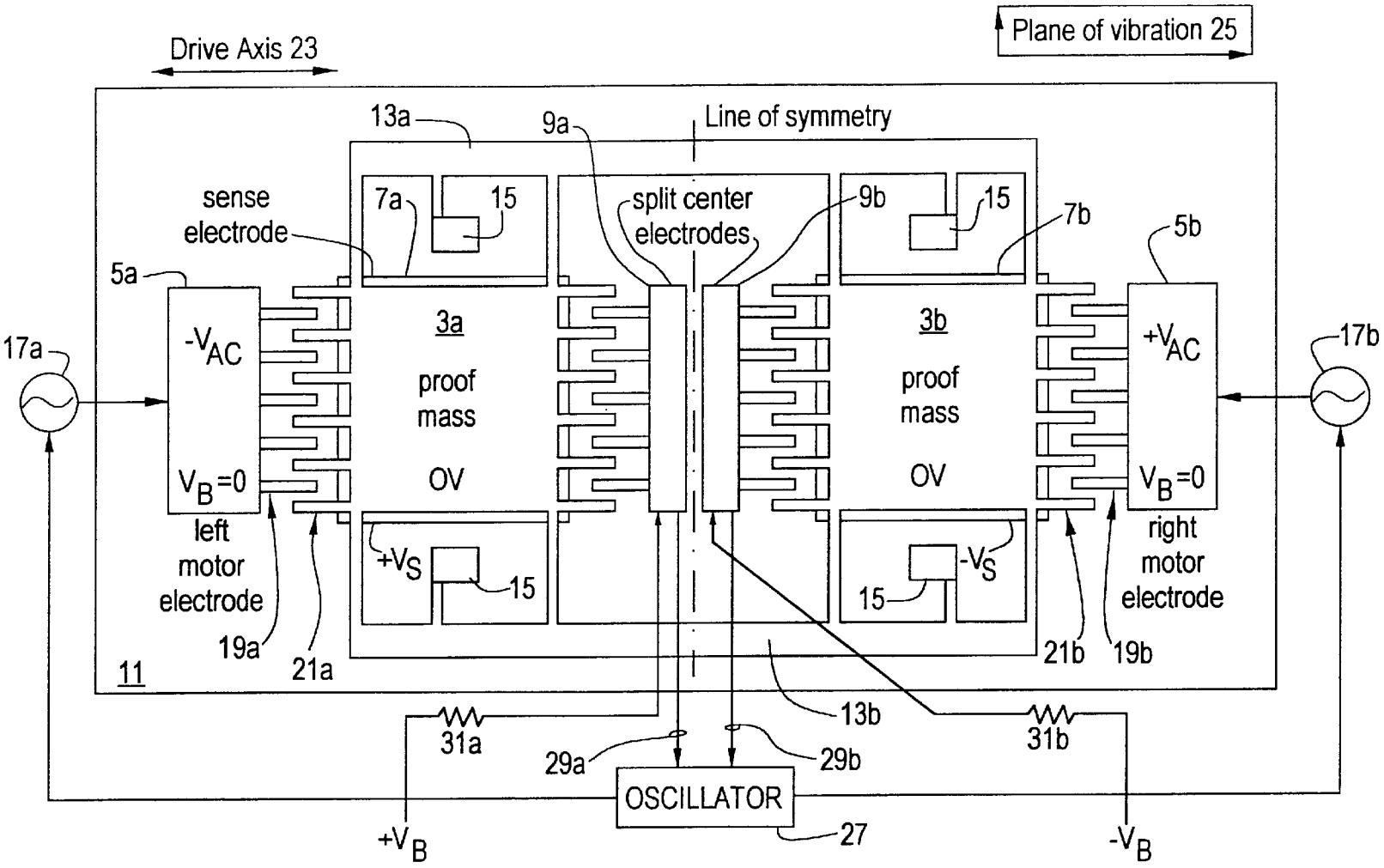
FIG. 2 is an enlarged sectional view of the unsigned holographic bank draft of FIG. 1, illustrating intact holographic embossing.

Using a bank draft as an example of a security document, a preferred embodiment of the holographic bank draft form (2) and a preferred method for using same are illustrated in FIGS. 1–6. In the preferred embodiment, the holographic bank draft form (2) includes a substrate (4) of paper or other material for supporting the holograms. The substrate (4) may include printed material such as the bank identification numbers (6) in magnetic ink as is used in conventional bank drafts, on the bottom margin (8) of the bank draft form (2). Overlaying part or all of the substrate (4) is a hologram (10) which is bonded or otherwise attached to the substrate (4) by the conventional method described below. Those items necessary to make a conventional bank draft form (2) which are not printed onto the substrate (4) can be printed or otherwise incorporated onto the hologram (10). For example, the name and address of the bank (12) and the drawer (14) and the executory language of the bank draft form (2) may be printed either onto the substrate (4) or onto the hologram (10). In a preferred embodiment, the signature entry area (16) for the drawer's signature (18) and the various data entry areas (20) of the bank draft form (2), e.g. the area for entering the date, the name of the payee, and the amount of the bank draft, are all incorporated into the hologram (10) area(s). Such items may be printed directly onto the hologram (10) and partially occult the holographic image. Alternatively, such items may be printed onto the substrate prior to overlamination of the hologram.

There are three types of preferred holograms (10) applicable to the present invention. The first type is a see-through thermoplastic refractive surface (8) formed by embossing or otherwise formed with a pattern of ridges (22) and troughs (24) in the submicrometer range for forming a conventional holographic pattern. This coating may be applied according to Dennison's method of high speed coating of thermoplastic coating on paper. Other methods include hot-stamping a holographic image foil (10) with heat activated adhesive onto the substrate (4), or, attaching the hologram to the substrate with pressure sensitive adhesive. These methods are all well known in the industry. Other conventional methods for embossing, electroplating, etching, ion etching, etc. are well known and may be employed for forming holograms (10) of this type, i.e. of the type which has a pattern of ridges (22) and troughs (24). The see-through thermoplastic may be made of polymers such as polypropylene, polyvinyl chloride, styrene, polyacrylics, poly acetates, etc. as are conventionally used in such applications. They can also be modified, e.g. by doping with materials to enhance the refractivity and/or to increase the difficulty for counterfeiters to duplicate. For examples, they may be doped with small amounts of thermochromic or photochromic dyes such as those available from Davis Liquid Crystals, Inc., or fluorescent dyes such as those available from SICPA Secureink Corp, or De la Rue Corp., etc.

The second type of preferred hologram (10) is a modification of the first by having a very thin coating of metal, i.e. in the order of tens of Angstroms thick, thus retaining the see-through property while enhancing the reflectivity of the hologram where desired without making it too reflective so as to be unsuitable for legitimate photocopying.

The third type of preferred hologram (10) employs a see-through photosensitized polymeric layer having an alternating pattern of dark and bright contrasting lines within the submicrometer range for forming the holographic image, such as those available from Du Pont.

If the surface of the hologram (10) is incompatible with the application of ink, then an ink compatible layer (26) or primer may be applied as a thin coating over the entire hologram (10). Or, alternatively, such surface can be made ink-compatible through corona discharge, a technique well known in the industry. In an alternative embodiment, the ink-compatible layer (26) is applied to only those areas on which data must be affixed. The coating of ink-compatible material (26) over the hologram may also take other patterns. Several materials well known in the industry are suitable as ink-compatible coatings. Polyvinyl or polyacetate, for examples, may serve as a preferred composition of the ink compatible layer (26).

Figure 3:
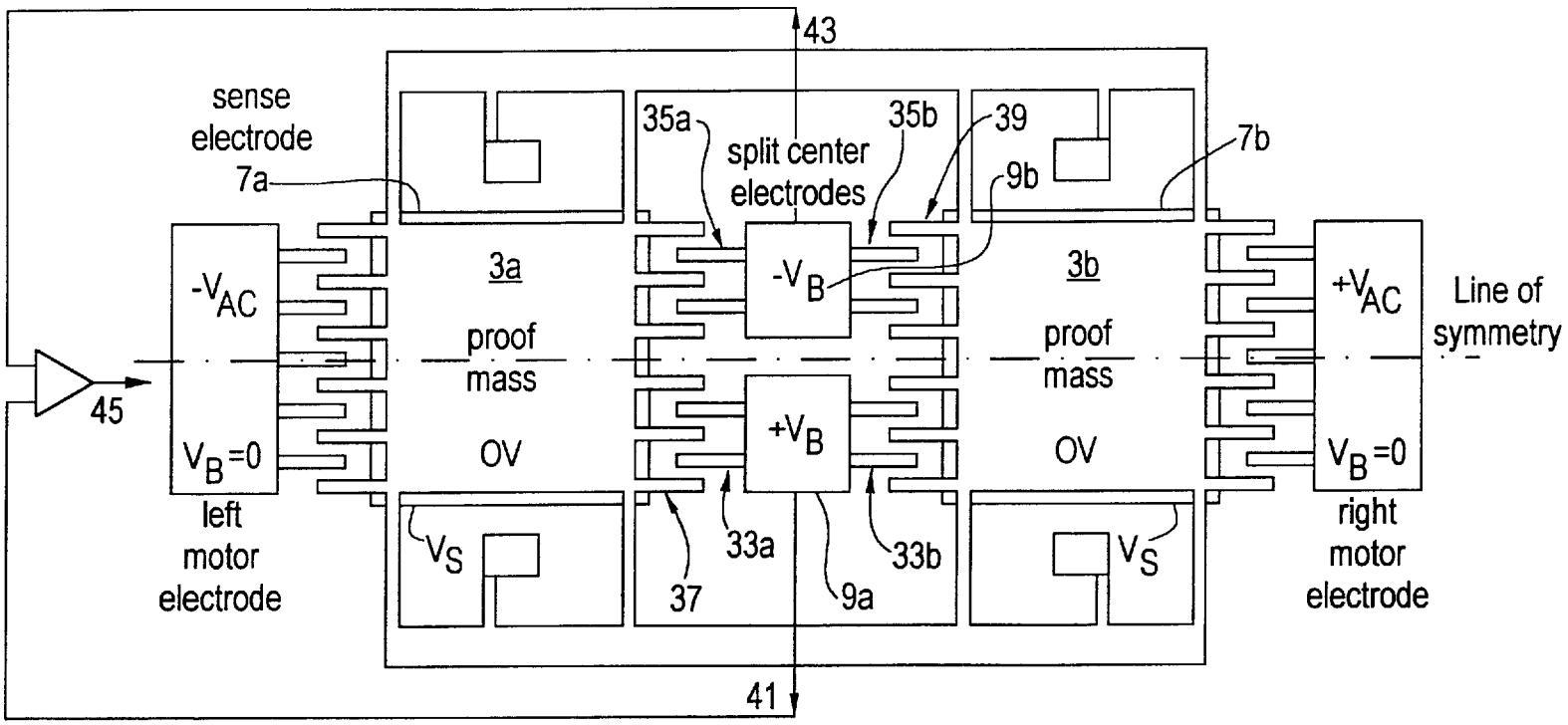
FIG. 3 is a view of a holographic bank draft form onto which the drawer's signature has been affixed and onto which the terms of the bank draft have been entered.
Figure 4:
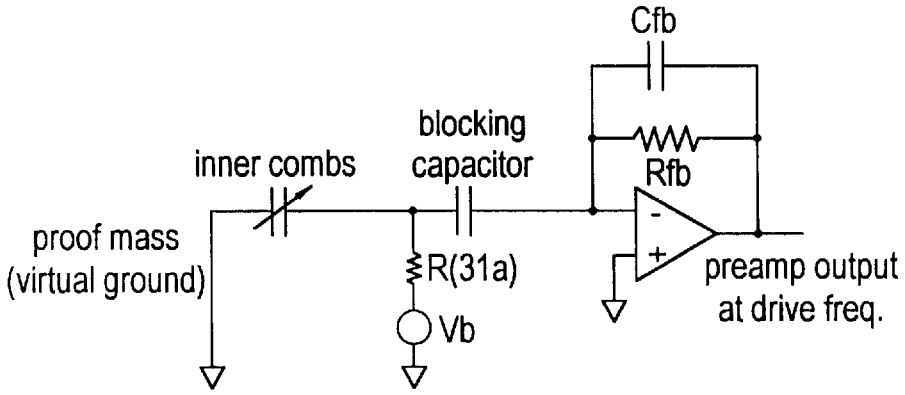
FIG. 4 is an enlarged sectional view of the holographic bank draft form of FIG. 3, illustrating holographic embossing which has been partially destroyed by a signature.

Once the hologram (10) has been overlaid onto the substrate (4) and the hologram (10) has been coated or partially coated with a thin layer of ink-compatible layer (26), an executed holographic bank draft or document (2) may then be formed from the blank holographic bank draft or document from (2) by entering the appropriate data into the data entry areas (20) (i.e. the date, name, values etc.) and then affixing the issuer's signature (18) onto the signature entry area (16) of the hologram (10) as illustrated in FIG. 3 and 4. In the preferred mode, affixation of the signature(s) (18) should be done with an ink writing instrument, or an instrument that etches into the hologram, e.g. a pen, an impact dot-printer, or computer directed laser beam writer. Entry of the terms of the bank draft and other data to holographic areas may also be made by inked pens, by typewriters, printers, laser writer, etc. If the hologram (10) is made of photosensitive polymeric layer, then the affixation of the signature (18) serves to partially deface the holographic image by blocking or occulting that portion of the hologram (10) over which the signature (18) is affixed. On the other hand, if the hologram (10) is of the type which includes a pattern of ridges (22) and troughs (24), then the affixation of the signature (18) serves to partially deface the holographic image both by etching the signature (18) onto the embossed holographic pattern and by partially blocking or occulting that portion of the hologram (10) over which the signature (18) or data is affixed.

Figure 5:
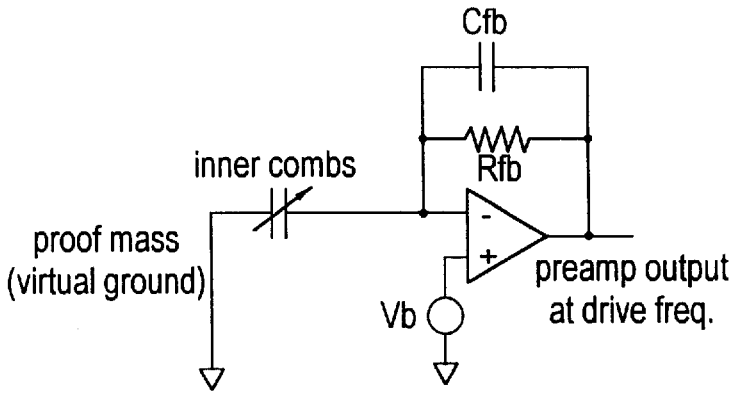
FIG. 5 is a plan view of a completed bank draft form with a protective laminate thereover.
Figure 6:
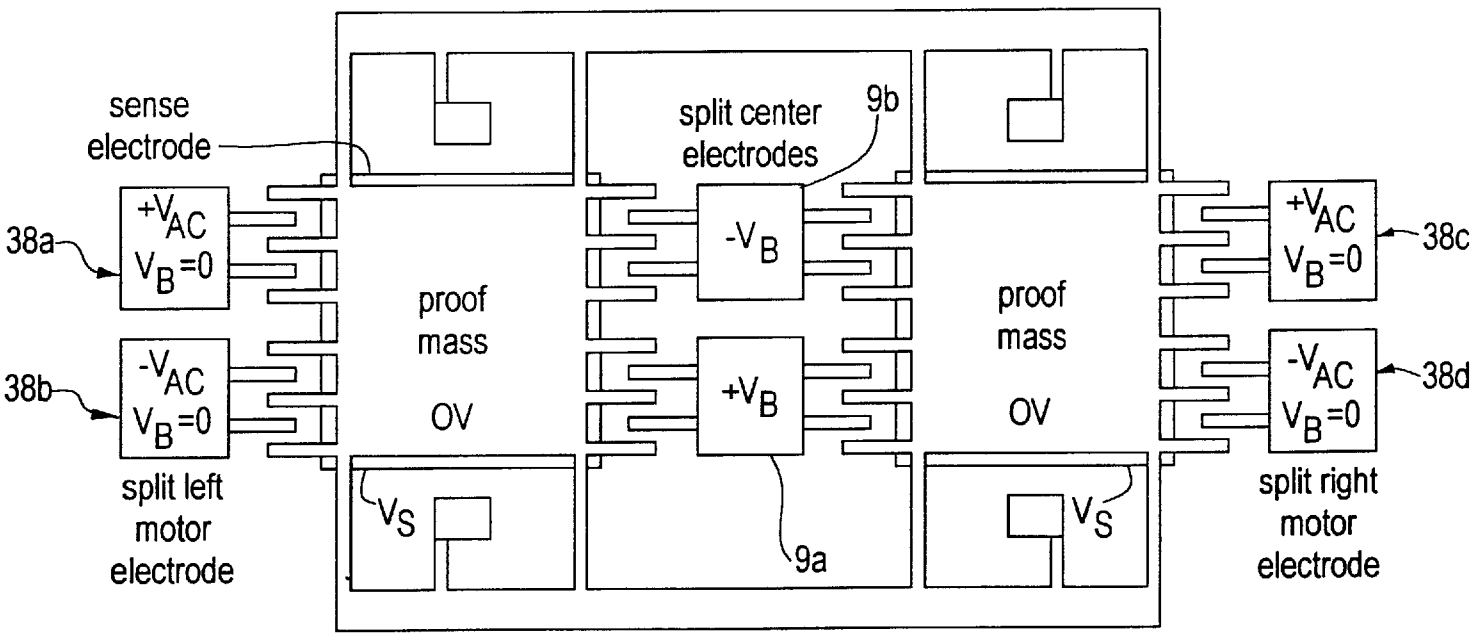
FIG. 6 is an enlarged sectional view of the completed holographic bank draft of FIG. 5 illustrating a transparent protective layer covering the signature.
Figure 1:
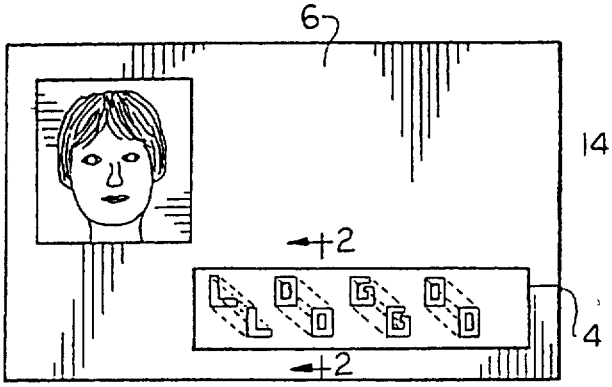
Figure 2:
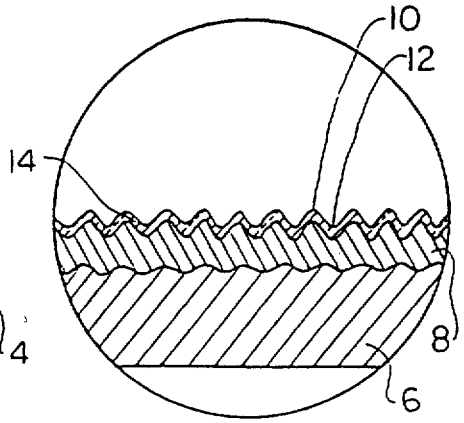
Figure 3:
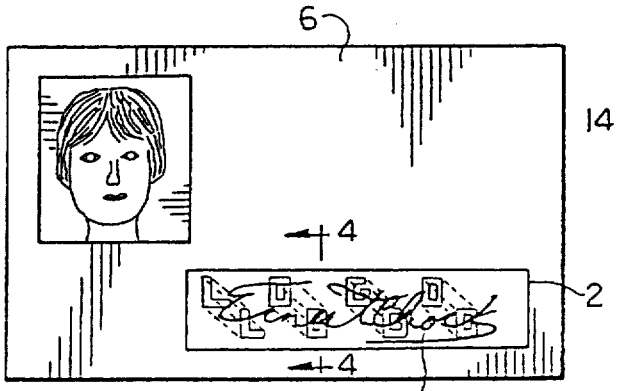
Figure 4:
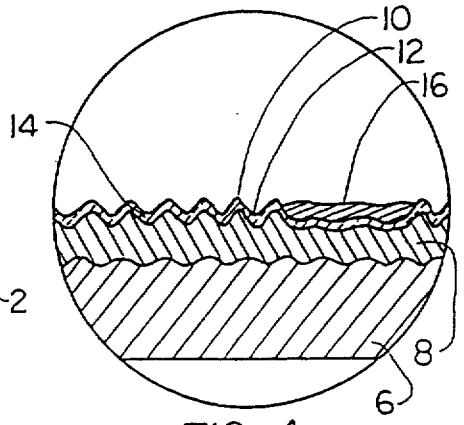
Figure 5:
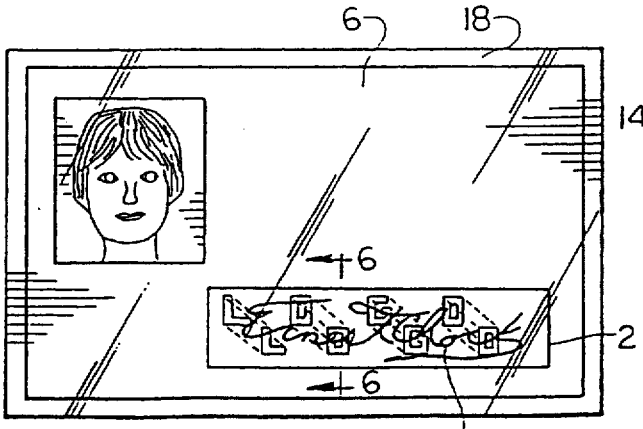
Figure 6:
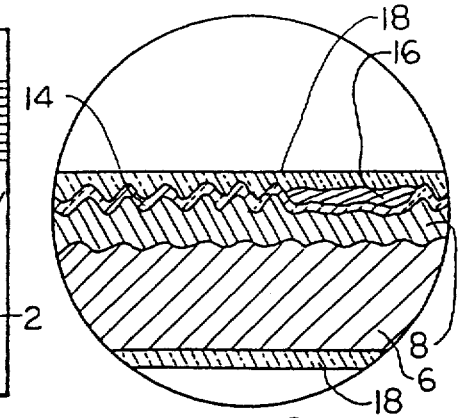

FIGS. 5 and 6 illustrate a preferred embodiment of the holographic bank draft (2) which includes a protective laminate (28) for covering the signature (18) and for preventing or deterring its alteration or removal. A preferred protective laminate (28) has a composition of mylar or other transparent film, and may cover not only the signature (18) but also the hologram (10) and/or the entire substrate (4) which supports the hologram (10). The protective laminate (28) should be transparent. Conventional transparent adhesive tape applied to the hologram (10), for example, may also be employed as a protective laminate (28). Thus, after the holographic bank draft form (2) is completed and executed, the holographic portion may then be optionally covered with a protective laminate (28) so as to prevent alteration.

In an alternative embodiment, the holographic document form (2) comprises a substrate (4) and a holographic sticker panel (10), i.e. a tamper-proof adhesive-backed holographic panel or label (10). The document (2) is signed by the user or user's agent by applying the holographic sticker panel (10) to the substrate directly prior to use. The holographic sticker panel (10) may include one or more signature entry areas (16) and/or data entry areas (20). In a preferred mode, the signature entry area and/or data entry areas of holographic sticker panel (10) are filled in by the user after its attachment to the substrate (4). However, in some instances, it may be possible for the user to fill-in the signature and/or data entry areas of the holographic sticker panel (10) prior to its transfer onto the substrate (4). A preferred tamper-proof adhesive-backed holographic panel (10) may includes a tear pattern or image. Once the holographic panel (10) is applied to the substrate (4), any attempt to peel the holographic panel (10) therefrom causes the holographic image to become destroyed due to the uneven attachment of the adhesive backing to the substrate (4) leaving a predetermined tear pattern or a word such as "VOID" on the substrate (4), for example. Such tamper-proof adhesive backed holographic panel (10) with designed tear patterns are available from Flexcon, Inc. (Spencer, Mass.), or from Bridgestone Graphic Technologies, Inc. (Bridgeport, Conn.), for example. As an additional feature, the tamper-proof adhesive-backed holographic panels (10) may be printed with serial number, or bar code. The serial numbers or bar code may be logged on a separate registry maintained by the issuing office or bank. If the document is stolen, the absence of a valid serial number or bar code number on the holographic sticker panel (10) may be ascertained by the issuing office or bank by comparing the submitted serial number or bar code with the registry of valid serial numbers or code. The failure of a submitted serial number or code to correlate with a valid serial number or code logged onto the bank's or issuing office's registry, may alert the office or bank to the possibility that a submitted check or document is invalid.

What is claimed is:

1. In an improved form for a bank draft or document, the form including:

a printed substrate with data entry area for entering and displaying one or more terms of the bank draft or document;

a signature entry area located on the printed substrate, for affixing and displaying a signature of a drawer of the bank draft;

a hologram extending over said signature area or forming a holographic image thereupon, said hologram being coated with a transparent layer of ink compatible material suitable for affixing the signature of the drawer thereonto and suitable for displaying the signature of the drawer over the holographic image, the improvement comprising:

wherein the hologram is see through; and the printed substrate includes photo-chromic material, prior to coverage by the hologram.

2. An improved form of a document as shown in claim 1, improvement further comprising:

the hologram also extending over said data entry for forming a holographic image thereupon, said hologram being coated with a transparent layer of ink compatible material within said data entry area suitable for entering one or more terms of the bank draft and suitable for displaying the terms of the bank draft over the holographic image.

3. An improved form of a document as shown in claim 1, wherein the printed substrate includes thermo-chromic material, prior to coverage by the hologram.

4. An improved form of a document as shown in claim 1, wherein the printed substrate includes fluorescent material, prior to coverage by the hologram.

5. An improved form of a document as shown in claim 1, wherein the printed substrate includes magnetic ink prior to coverage with the hologram.

6. An improved form of a document as shown in claim 1, wherein said printed substrate is printed with bar-code, prior to coverage with the hologram.

7. An improved form of a document as shown in claim 1, wherein the hologram has a polymeric composition.

8. An improved form of a document as described in claim 7, wherein the hologram composition includes photo-chromic material.

9. An improved form of a document as described in claim 7, wherein the hologram composition includes thermo-chromic material.

10. An improved form of a document as described in claim 7, wherein the hologram composition includes magnetic material.

11. An improved form of a document as described in claim 7, wherein the hologram composition includes fluorescent material.

12. An improved form of a document as described in claim 7, wherein the hologram is printed with bar-code.

13. An improved form according to claim 1, wherein the hologram covers the entire printed substrate.

* * * * *

UNITED STATES PATENT AND TRADEMARK OFFICE

CERTIFICATE OF CORRECTION

PATENT NO. : 5,857,709
DATED : Jan. 12, 1999
INVENTOR(S) : Chock

It is certified that error appears in the above-identified patent and that said Letters Patent is hereby corrected as shown below:

The title page should be deleted to appear as per attached title page.

Please delete drawing sheets 1-5 and substitute drawing sheet 1 of 1 as per attached.

Signed and Sealed this
Fourth Day of January, 2000

*Attest:*

*Attesting Officer*

*Acting Commissioner of Patents and Trademarks*

US005857709A

United States Patent [19]

Chock

[11] Patent Number: 5,857,709

[45] Date of Patent: Jan. 12, 1999

[54] ANTICOUNTERFEIT DOCUMENTATION WITH SEE-THROUGH AND WRITE-ABLE HOLOGRAM

[76] Inventor: Ernest P. Chock, 1048 24th St., Santa Monica, Calif. 90403-4528

[21] Appl. No.: 805,130

[22] Filed: Feb. 24, 1997

[51] Int. Cl.[6] ..... B42D 15/00

[52] U.S. Cl. ..... 283/86; 285/58; 359/2

[58] Field of Search ..... 283/85, 86, 58, 283/92, 94, 103, 114, 901; 359/1, 2; 430/1, 2

[56] References Cited

U.S. PATENT DOCUMENTS

| | | | |
|---|---|---|---|
| 4,634,148 | 1/1987 | Greene | 283/58 |
| 5,109,318 | 4/1992 | Mantegazza | 283/58 |
| 5,267,753 | 12/1993 | Chock | 283/86 |
| 5,509,692 | 4/1996 | Oz | 283/58 |
| 5,636,874 | 6/1997 | Singer | 283/58 |

*Primary Examiner*—Willmon Fridie, Jr.
*Attorney, Agent, or Firm*—T. J. Singh

[57] ABSTRACT

A security document form such as a bank draft, or other document of value may incorporate a see-through and write-able hologram or diffractive grating as an anticounterfeit measure. The hologram may extend over all or a portion of the form such as the signature entry area and other data entry areas of the form, e.g. the date, name and numerical value areas. A Previous patent utilizing metallized holograms for such applications does not permit good photocopying or microfilming of the document on account of their high reflectance. This photocopying problem is solved by using a see-through, writable hologram which allows clearly legible photocopies to be made for legitimate use but appearing clearly fraudulent when passed off as the original. An ink-compatible top surface is made by coating with ink-receptive material or by corona discharge treatment as is well known in the industry. Writing or impact printing over the ink-compatible surface of the hologram partially occults the hologram underneath such writing and may cause the embossed surface of the hologram to become etched, so that even if the ink is somehow erased or removed, the writing trace would still remain, thus making it unalterable. The use of such an overlaminated hologram or diffractive grating can be accomplished by tamper-proof pressure sensitive holographic labeling, by hot-stamping the hologram with heat activated adhesive backing, or by embossing the hologram onto polymeric thermoplastic directly coated on the substrate paper or plastic card. The use of such a writable hologram also permits incorporation, of many other anticounterfeit features. Optionally, the hologram may also be covered with a protective laminate after the writing has been applied. This invention thus offer an aesthetically pleasing and cost effective means of forgery prevention for large volume users, while making it prohibitively costly for those attempting to counterfeit.

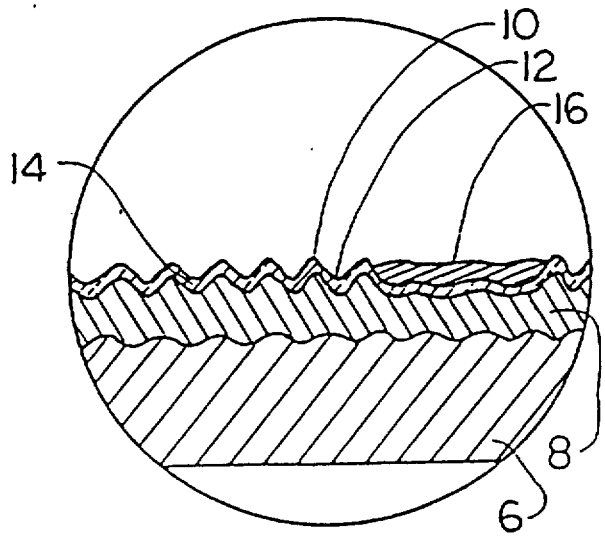

13 Claims, 1 Drawing Sheet